US005240077A

United States Patent [19]

Whitsitt

[11] Patent Number: 5,240,077

[45] Date of Patent: Aug. 31, 1993

[54] VOLTAGE CONTROLLED HYDRAULIC SETTING TOOL

[75] Inventor: John R. Whitsitt, Dallas, Tex.

[73] Assignee: Dresser Industries, Inc., Dallas, Tex.

[21] Appl. No.: 900,613

[22] Filed: Jun. 18, 1992

[51] Int. Cl.[5] ..... B21B 23/06

[52] U.S. Cl. ..... 166/383; 166/66.4; 166/120

[58] Field of Search ..... 166/382, 383, 385, 386, 166/387, 120

[56] References Cited

U.S. PATENT DOCUMENTS

| | | | |
|---|---|---|---|
| 3,903,965 | 9/1975 | Ahlstone | 166/182 |
| 4,350,205 | 9/1982 | Goldschild et al. | 166/131 X |
| 4,493,374 | 1/1985 | Magee, Jr. | 166/382 |
| 4,545,433 | 10/1985 | Wambaugh | 166/135 X |
| 4,554,973 | 11/1985 | Shonrock et al. | 166/135 X |
| 4,856,582 | 8/1989 | Smith et al. | 166/98 |
| 5,137,086 | 8/1992 | Stokley et al. | 166/66 X |

*Primary Examiner*—Ramon S. Britts
*Assistant Examiner*—Frank S. Tsay
*Attorney, Agent, or Firm*—Hubbard, Thurman, Tucker & Harris

[57] ABSTRACT

A setting tool for setting in a bore hole a downhole device such as plugs and packers is actuated by supplying a voltage signal to direct current motor that drives a hydraulic pump. The hydraulic pump delivers high pressure fluid to a setting chamber to displace a piston received therein. Relative movement of the piston to the chamber imparts a setting force to the downhole device with a shearing action between an outer setting sleeve and an internal mandrel. A hydraulic fluid reservoir is located on the backside of the setting piston, such that displacement of the setting piston during setting forces fluid toward the pump. An accumulator located between the reservoir and the pump accommodates thermal expansion of the fluid. A relief valve at the outlet of the pump provides back pressure to ensure that a minimum positive pressure is maintained at the intake of the pump. A second setting stage provides additional setting force. Controlling the voltage level of the signal to the motor permits control over the setting tool's stroke and actuation rate to permit fine control over setting.

17 Claims, 8 Drawing Sheets

VOLTAGE CONTROLLED HYDRAULIC SETTING TOOL

FIELD OF THE INVENTION

The invention relates to a setting tool for setting downhole devices in bore holes, and more particularly to a wireline conveyed setting tool that is hydraulically actuated with an electric motor.

BACKGROUND OF THE INVENTION

Setting tools are used in oil and other types of wells to "set" downhole devices such as packers and bridge plugs. Setting involves fixing or securing the device within the hole at a desired depth. To set a packer or bridge plug, it is coupled to a lower end of a setting tool at the surface using a frangible connection and then lowered down the well on a wire or cable. Once lowered to the desired depth, an outer sleeve of the tool is moved relative to an internal rod or mandrel to create a shearing action. This shearing or "setting" action compresses the packer or plug. Compressing the packer or plug, which is primarily composed of rubber or like materials, forces gripping slips on the outside of the packer or plug into the well casing, thereby setting the plug or packer. Once the packer or plug is set, an extra shearing force is applied to break the frangible connection to disconnect the setting tool for retrieval.

The force required to set the packer or plug, termed the setting force, depends on the size of the downhole device and hole. However, no matter the size, the force that is required is quite substantial given that it must be generated within the relatively small confines of a bore hole. In most setting tools, the setting force is generated by detonating an explosive charge or bomb within a firing chamber of the tool. Exploding gases compress hydraulic fluid, which in turn drives a piston that actuates the tool by moving its outer sleeve relative to its inner mandrel.

Using an explosive charge to actuate a setting tool has several problems. These problems are described in U.S. Pat. No. 4,493,374 of Robert L. Magee, Jr., titled "Hydraulic Setting Tool", which issued Jan. 15, 1985. One disadvantage is that explosives are dangerous, and their handling at drill sites slows down, complicates and increases the costs of setting down hole devices. A second disadvantage is that the firing chamber must also be cleaned between uses, thereby adding to the maintenance of the tool. A third disadvantage is that an explosion cannot be well controlled to provide a gradual actuation of the tool in order to allow elastomers and highly elastic materials of the plug or packer to respond and conform better to the contours of the well bore, thereby providing a better seal. Slow burning explosives and orifices through which hydraulic fluid is forced during the explosion have been used to slow down the sudden, initial force of the explosion. However, these methods do not result in a setting force that is constant. The setting force starts at a maximum at the beginning of the setting action or stroke of the tool and substantially drops along the setting stroke of the tool.

To overcome these disadvantages, U.S. Pat. No. 4,493,374 of Magee proposes using a motor to drive a radial piston pump that pressurizes hydraulic fluid. The pressurized fluid acts against and moves a piston portion of the setting tool. Movement of the piston causes the outer sleeve to move downwardly with respect to the inner rod. Thus, the hydraulic pressure thus may be gradually applied. This type of setting tool also has several other advantages. The stroke of the tool is not limited by the shortness of explosive force since the electric motor may continue to function as long as is necessary to supply enough hydraulic fluid to move the piston the desired length. And, because the tool need not be purged, cleaned and re-loaded with an explosive charge, it may make several successive runs very quickly. However, despite having many advantages over setting tools using explosive charges, the setting tool disclosed in Magee '374 has several shortcomings not previously noted which prevent it from operating as well as desired.

A hydraulic pump requires a minimum head or pressure at its intake, sometimes referred to as its low pressure side, in order to properly pressurize the fluid and avoid cavitation, as well as to ensure enough fluid around its intake to avoid entrainment of air. The Magee '374 setting tool uses a reservoir located above the hydraulic pump and below the motor to store fluid that will be pumped into the setting chamber for actuating the tool. The head on the low pressure side of the pump is thus simply the weight of the oil. As the temperature of the hydraulic fluid rises, the weight of the fluid decreases and the fluid becomes more susceptible to entrainment of air. Tilting of the reservoir when the tool is conveyed down a slant-bore exacerbates the threat of pump cavitation.

The failure to maintain viscosity of the hydraulic fluid and the propensity to pump cavitation of the Magee '374 setting tool are very undesirable attributes. These drawbacks not only decrease the life expectancy of motors and pumps, which are expensive due to the very large pressures they are required to develop, but also interrupt application of the setting force and cause premature failures.

The Magee setting tool has a further shortcoming in that the setting force it is capable of generating is not sufficient for some deep well applications. Although larger motors could be used to generate higher pressures on the hydraulic fluid, the bore hole limits the size of the motor.

It is therefore the object of the invention to overcome these problems and the very inhospitable conditions found in deep wells which affect the operation of hydraulically activated setting tools. It is the further objective of the invention to improve this type of setting tool with additional features to render it more useful in the field.

SUMMARY OF THE INVENTION

The invention is a hydraulic setting tool actuated with an electric motor driving a pump. Cavitation and entrainment of air at the intake of the pump are reduced or eliminated by use of a closed hydraulic system that maintains a minimum head or pressure of hydraulic fluid at the intake of the pump throughout the stroke of the setting tool. Viability of the setting tool in the inhospitable confines of wells under high temperatures and pressures is improved, as well as control over the setting action.

In accordance with various aspects of the preferred embodiments of the invention, hydraulic fluid is stored in a reservoir located on a backside or low pressure side of a setting piston. Displacement of the setting cylinder relative to the setting piston during actuation of the setting tool forces hydraulic fluid from the reservoir, up through a fluid passage way to an accumulator, and from the accumulator to the intake of the pump, where it is then pumped down to a setting chamber on a high pressure side of the setting piston. A relief valve at the output or downstream side of the pump provides back pressure to ensure that a minimum head pressure is maintained on the upstream side of the pump. Thus, a constant supply to the pump of hydraulic fluid under positive low pressure is assured and the risk of entrainment of air which causes cavitation is significantly reduced.

The accumulator, which includes a piston biased with a spring received within a cylinder, accommodates thermal expansion of the fluid under the relatively high temperatures sometimes encountered within wells. Without affecting maintenance of a minimum head on the low pressure side of the pump, the accumulator provides necessary additional volume on the low pressure side of the pump. Maintaining a minimum head on the low pressure side of the pump in this manner biases the setting tool to a closed or running position and provides excess oil on the low pressure side to compensate for the compressibility of the hydraulic fluid under high pressure. The minimum head further preloads the accumulator spring so that friction forces caused by the accumulator piston are easily overcome when necessary to accommodate fluid under thermal expansion.

The motor is a voltage controlled, direct current motor, the speed of which is dependent on the voltage applied to it. The pump is of the type having volumetric displacement dependent on its speed. The stroke of the setting tool at any given moment during its actuation may be ascertained from the voltage level applied to the DC motor and the duration of the application.

Inclusion of a second setting stage that doubles the area on which the pressurized hydraulic fluid acts, thereby doubling its setting force without increasing the requirement or the output pressure of the hydraulic fluid from the pump. The internal pressure of the setting tool is substantially balanced with the hydrostatic pressure of the well fluid. The hydrostatic pressure of the well fluids can be quite substantial at the very great depths at which such a setting tool is expected to operate. By balancing the internal and external pressures, no setting force is required to overcome the hydrostatic pressure on the tool during actuation. Further, there is no differential pressure on the mechanical seals in the tool to enhance its reliability. The electric motor is brushless so that it may be immersed in hydraulic fluid.

These and other aspects of the invention and their advantages are described in the following written description of the preferred embodiment of the invention shown in the accompanying drawings.

BRIEF DESCRIPTION OF THE DRAWINGS

FIGS. 1A, 1B, 1C, 1D, 1E, 1F, 1G and 1H are cross-sectional and cut-away elevational drawings, in some cases simplified for clarity or ease of presentation, illustrating segments of a first embodiment setting tool and.

DETAILED DESCRIPTION OF THE PREFERRED EMBODIMENT

Figure 1A:
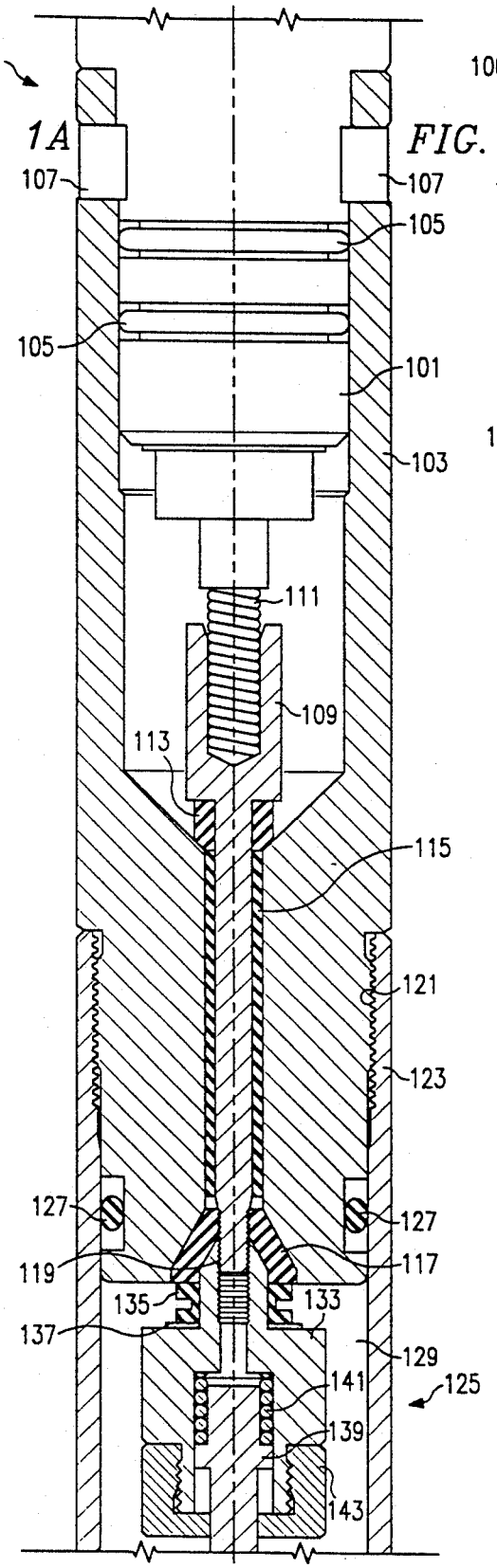

Referring now to FIG. 1A, setting tool 100 is a tubular-shaped exterior for dropping down a bore-hole. It is comprised of several sections having circular outer surfaces of the same diameter that are threaded onto each other. Spanner wrench holes 206 are provide on several of the sections to facilitate screwing the sections together. The sectional construction of the setting tool permits ease of manufacture, assembly and repair. However, it is possible for any two or more of the sections to be integrally formed. A top connection section 103 of setting tool 100 is receiving a representative "field connection" 101, to which the setting tool 100 will be attached. The field connection hangs on the end of a wire-line cable (not shown) and permits attaching tools to the end of a wire-line cable so that the attached tool may be provided with either a direct current or and alternating current electrical signal on the wire-line cable. A pair of O-ring seals 105 surround the field connection 101 and seal the inside of the top connection 103 against well fluids. Screws 107 secure top connection 103 to a field connection 101.

The field connection 101 is coupled to a "hot" lead in the wire-line cable. The body of the field connection is connected to a ground line. Spring 111 is coupled to the "hot" lead and is inserted into a cable head receptacle 109 to make an electrical connection between the field connection 101 and the setting tool 100. Cable head receptacle 109 is a solid piece of conductive material that extends through the top connector 103. The cable receptacle is insulated from the top connector with top insulator 113, internal insulator 115 and bottom insulator 117. Cable head receptacle 109 terminates in a threaded portion 119.

Top connection 103 is connected to tubular motor housing 125 using a threaded bottom section 121 onto which is screwed a threaded top section 123 of motor housing 125. O-rings 127 seal the connection. Plunger assembly 129 electrically couples cable head receptacle 109 to motor 131. Electrically conductive plunger housing 133 screws onto threaded end 119 of cable head receptacle 109. Grommet 135, held in place by washer bearing 137, separates the electrically conductive plunger housing 133 from top connection 103, which is at ground. The grommet also acts as a rubber spring to prevent the plunger assembly from backing off because of vibration. Plunger housing 133 is electrically coupled to an electrically conductive plunger piston 139 with electrically conductive coiled spring 141. Piston 139 is retained with plunger retainer 143 that is made of insulating material.

Motor 131, shown in cut-away elevation for simplicity, receives plunger piston 143 and thereby establishes an electrical connection for receiving electrical power from the surface via the wire line. The motor is grounded to its body, which is in electrical contact with motor housing 125. Motor housing 125 is electrically coupled to top connection 103, which, as previously stated, is at ground.

Figure 1B:
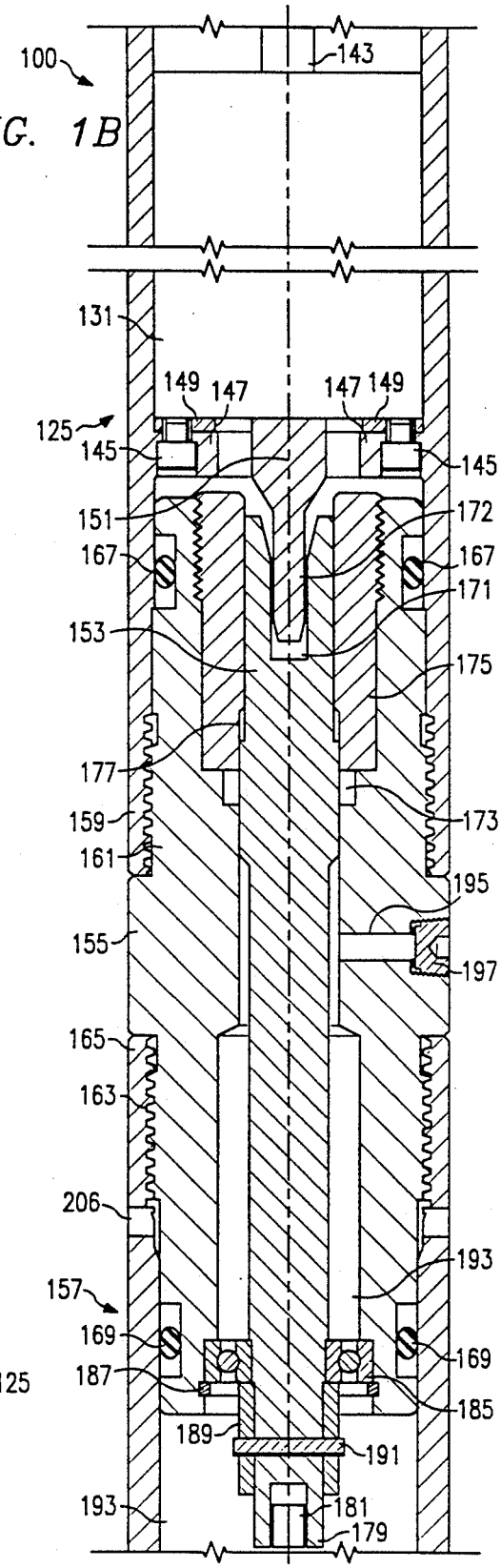

Referring to FIG. 1B, motor 131 is secured to tubular-shaped motor housing 125 with screws 145. The screws extend through flange section 147 of tubular motor housing 125 and gaskets 149, and into the motor. The gaskets provide shock isolation for the motor.

Motor 131 is a commercially-available direct current (DC) motor having permanent magnets. Please note that it is not shown in the cross-section. It must be capable of operating at high temperatures found in wells. An alternating current (AC) motor may be substituted if desired. However, a DC motor is preferred. Its speed is proportional to the voltage of the electrical signal provided to it from the surface, making control of its speed simpler than that of an AC motor.

Motor housing 125 is secured to drive shaft housing 155 by screwing into threaded bottom portion 159 of motor housing 125 a threaded top portion 161 of drive shaft housing 155. Attached to the other end of drive shaft housing 155 is pump housing 157. Drive shaft housing carries drive shaft 153 that couples motor shaft 151 to an input drive shaft 181 of hydraulic pump 183 (FIG. 1C) in the pump housing 157.

Upper threaded portion 163 of pump housing 157 is screwed onto bottom threaded portion 165 of drive shaft housing 155. O-rings 167 and 169 seal, respectively, the interior of motor housing 125 and interior of pump housing 157 from well fluids.

Drive shaft 153 includes a slot 171 for receiving a flattened portion 172 of motor shaft 151. This provides a rotational coupling with freedom in axial movement of the motor shaft 151 relative to the drive shaft 153. This reduces the likelihood of axial loading on the motor shaft 151 that could damage the motor. Similarly, the other end of drive shaft 153 includes a slot 179 for receiving flattened portion of input drive shaft 181 for the hydraulic pump.

The drive shaft 153 is axially retained by ball bearing assembly 185. Its axis of rotation is supported principally by the drive shaft housing at rotary seal profile 173, which profile contains a rotary seal that is not shown for simplification of the drawings, and by ball bearing assembly 185. The rotary seal is held by retainer 175 that screws into the drive shaft housing 155 between the housing and the drive shaft 153. The ball bearing assembly 185 is placed between the drive shaft 153 and an interior surface of the drive shaft housing 155, and held there with retaining ring 187 and collar 189. Collar 189 surrounds the drive shaft 153 and is held in place with pin 191.

The retainer 175 and drive shaft 153 are provided with cooperating shoulders 177. The shoulders limit movement of the drive shaft 153 toward the motor. This is necessary because of the possibility that a rotary seal in profile 173 could fail, causing a large axial force to be applied to the drive shaft toward the motor 131 that could damage it.

The primary purpose of a rotary seal in profile 173 is to prevent hydraulic oil from flowing along the drive shaft 153 from chamber 193 of pump housing 157 into the motor housing. When priming the setting tool 100, hydraulic oil fills pump chamber 193, up through ball bearing assembly 185 (thus providing a means for lubricating the ball bearing) and up to port 195. Port 195 is sealed by plug 197. Plug 197 is removed to release air and is then replaced when oil flows out. During operation of the tool, pump chamber 193 remains filled with oil.

Figure 1C:
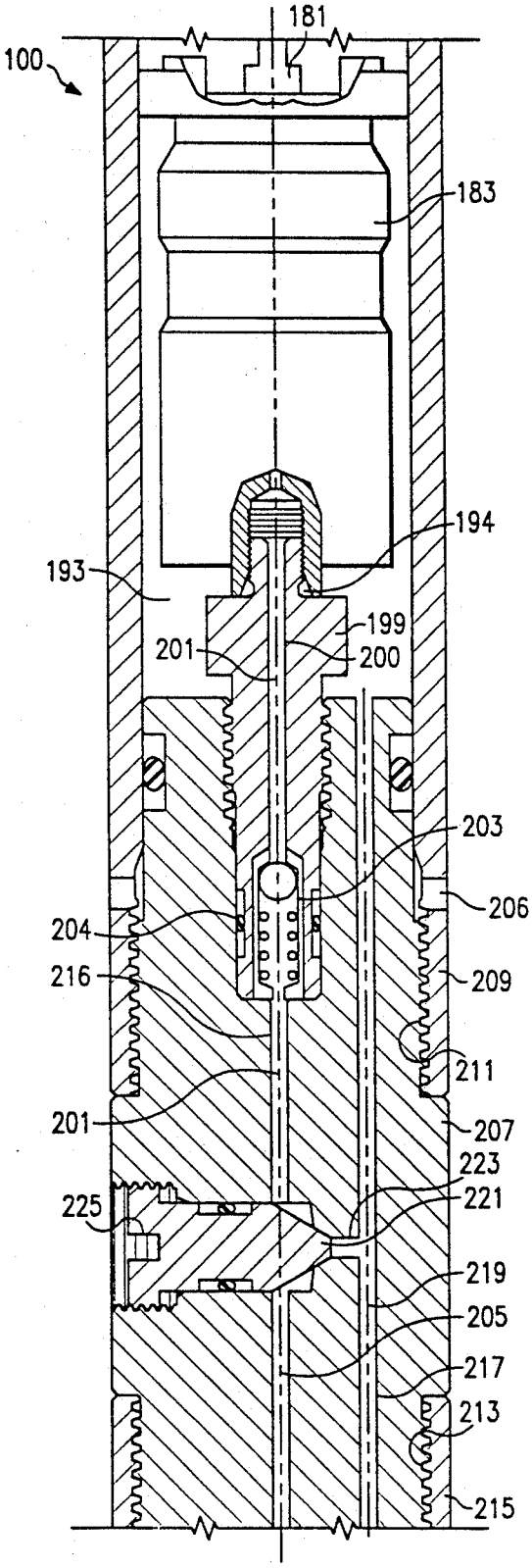

Referring now to FIG. 1C, the hydraulic pump 183 is a commercially available, axial piston hydraulic pump. Note that most of pump 183 is not shown in cross-section. The displacement of the pump is proportional to the speed at which the pump is driven by drive shaft 153, assuming that there is little compression of hydraulic fluid being pumped and no air entrained in the fluid. The bottom of pump 183 is screwed onto a top portion of pump mount 199. Profile 194 contains a metal seal that is not shown in order to simplify the cross-section.

Pump mount 199 includes a hole 200 defined therein extending axially through the mount that forms high pressure fluid channel 201 for carrying high pressure hydraulic fluid. Interposed in hole 200 is a pressure relief valve 203 that is fitted into pump mount 199. The pressure relief valve remains closed until hydraulic fluid within the high pressure fluid channel 201 achieves a predetermined minimal force to open it. As will be subsequently described, the pressure relief valve allows creating during priming, and maintaining during the setting tool's operation, a positive charge or pressure of oil on the backside of the pump or low pressure side, and helps to ensure that pump chamber 193 is constantly filled with fluid under positive pressure. Maintaining positive low pressure on the backside of the pump assists in preventing entraining of air in the pump and caviation.

Threaded lower portion of pump mount 199 is screwed into a threshold receptacle defined in valve block 207. To secure pump housing 183 to the valve block 207, the lower section of the pump housing has a threaded interior surface that screws onto a threaded exterior surface 211 of valve block 207. Similarly, screwed onto threaded exterior surface 213 of a lower end of valve block 207 is upper threaded end of tubular-shaped accumulator housing 215.

Hole 216 defined in the valve block 207 forms high pressure fluid channel 201 within the valve block. A hole 217 defines a low-pressure channel 219. The low pressure channel 219 connects chamber 193 of pump housing with an accumulator fluid chamber 220 (FIG. 1D), providing fluid communication between the pump and the reservoir. A by-pass valve 221 couples high pressure fluid channel 201 and low pressure channel 219 through by-pass channel 223. The valve is normally closed, as depicted, during its running, and permits hydraulic fluid under high pressure to flow uninterrupted. After the setting tool is actuated, the valve is opened by twisting screw portion 225 of the valve. Fluid under high pressure in the high pressure supply line flows through channel 223, into low pressure supply line 219, and then empties into accumulator fluid chamber 220 or pump housing chamber 193 until the pressure is equalized or the valve is closed. This relieves high pressure and permits collapsing of the tool without losing hydraulic oil.

Figure 1D:
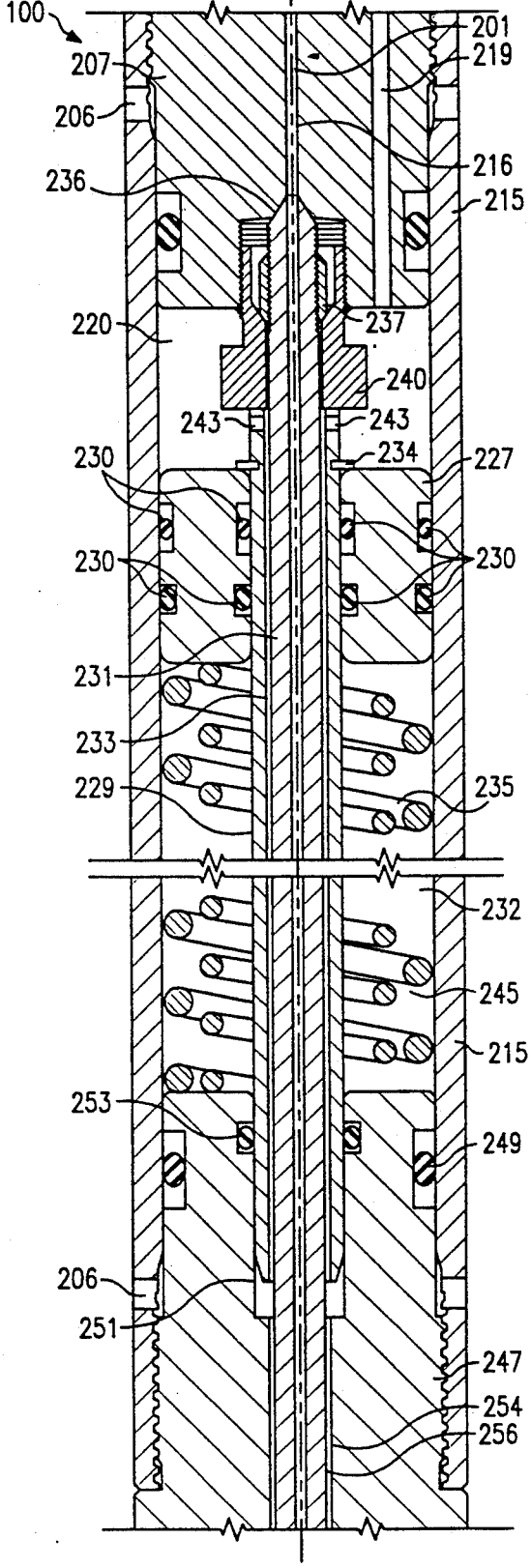

Referring now to FIG. 1D, shown is an accumulator section of the setting tool 100. The accumulator housing 215 is a cylinder in which an accumulator piston 227 translates along a hollow accumulator mandrel 229 extending through the center of the cylinder. O-ring seals 230 forms seals between accumulator fluid chamber 220 and an atmospheric chamber 232. A retainer ring 234 prevents upward movement of the piston beyond ports 243.

Through the hollow center portion of the accumulator mandrel 229 runs a smaller diameter high-pressure tube 231. Between the high pressure tube 231 and the inner wall of hollow accumulator mandrel 229 is an annular low-pressure conduit 233. The high pressure tube 231 carries high pressure hydraulic fluid from the valve block 207. To establish fluid communication between the high pressure tube 231 and hole 216, a top end of high pressure tube 231 seats within a pocket 236, located at the open-ended termination of hole 216. A collar 237 screwed onto a threaded portion of high pressure tube 231 and gland 240 screwed into the valve block 207 cooperate to force high pressure seal against the pocket and thereby provide a sufficient seal.

Figure 1E:
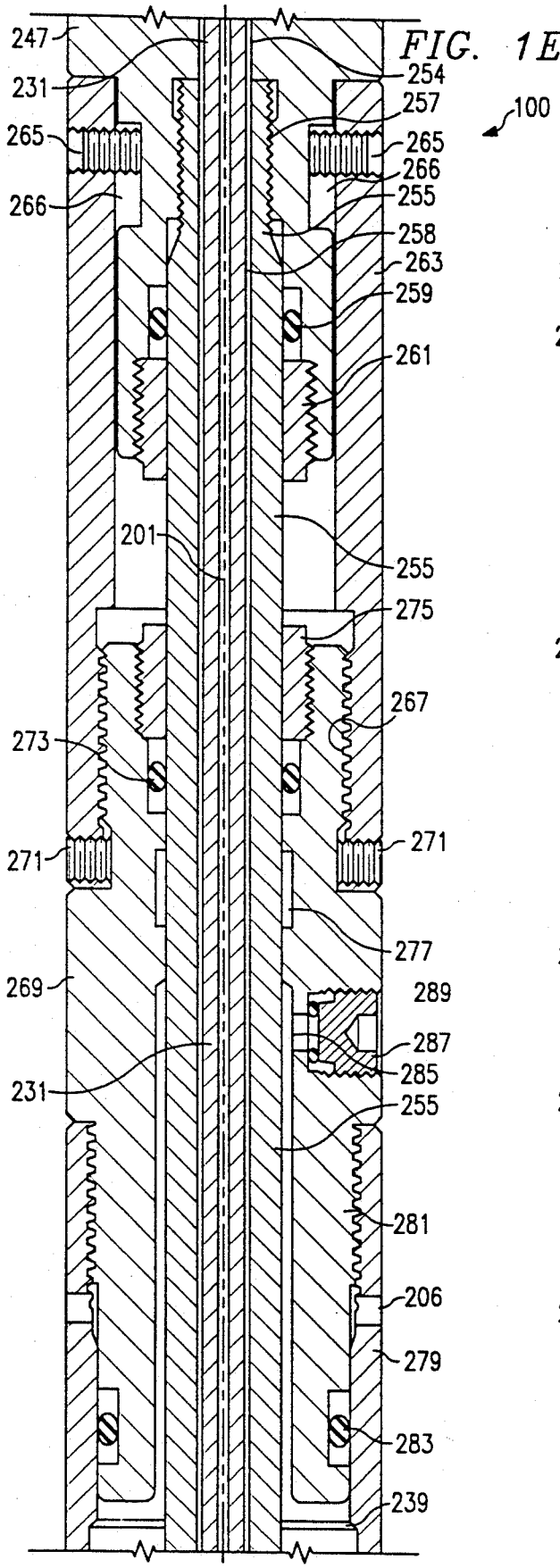
Figure 1F:
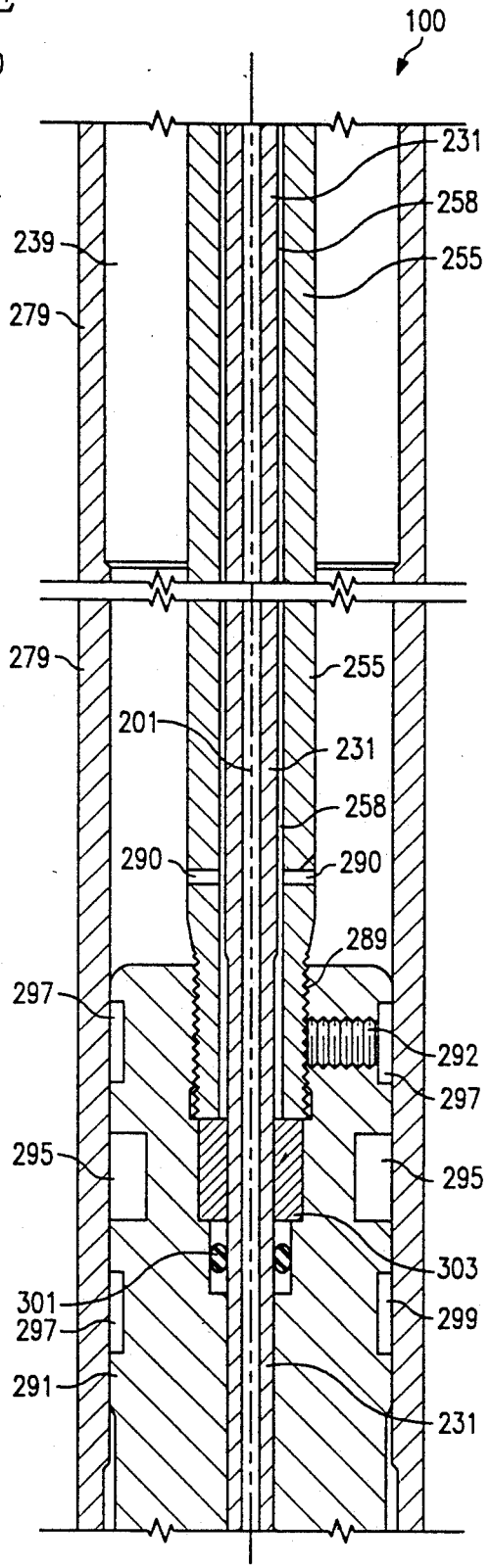

The low pressure conduit 233 carries hydraulic fluid (not shown) under low pressure from a reservoir 239, shown in FIG. 1F, up the accumulator, out ports 243 and into accumulator fluid chamber 220.

The volume of accumulator fluid chamber 220 depends on the pressure of the hydraulic fluid stored therein. Two co-axial helical springs 235 disposed around mandrel 229 are under compression and apply an upward force on the accumulator piston 227. The amount of displacement of the piston, and consequently the volume of the accumulator chamber increases with an increase in fluid pressure.

The accumulator forms part of a closed hydraulic system and serves several purposes. It allows for thermal expansion of hydraulic fluid on the back side of the pump, provides positive low pressure on the back side of the pump, and permits extra hydraulic fluid to be added to the low pressure side of the pump to compensate for compression of fluid that occurs on the high pressure side of the pump. Furthermore, during running of the setting tool, high temperatures in the bore-hole may cause the hydraulic fluid to expand, thus substantially increasing pressure in the accumulator chamber to potentially catastrophic levels that affect the running of the tool. To accommodate the fluid expansion, increasing pressure displaces the accumulator piston and thereby increases the volume of the accumulator fluid chamber 220 to relieve the pressure buildup.

A bottom threaded portion of the accumulator housing screws onto a top threaded portion of a setting mandrel carrier 247. The joint there between is sealed with an O-ring seal 249 against well fluid. Defined within the mandrel carrier is a cylindrical receptacle 251 which receives a bottom end of accumulator mandrel 229. O-ring 253 creates a seal between the outer surface of mandrel 229 and the inner portion of the receptacle 251 so that hydraulic fluid under low pressure does not leak into air chamber 232. The high pressure tube 231 passes through a hole 254 in mandrel carrier 247 to form therebetween an annular-shaped low pressure conduit 256.

Referring now to FIG. 1E, a top, threaded portion of tubular feedback mandrel 255 is screwed into threaded receptacle portion 257 of mandrel carrier 247. The feedback mandrel includes a hollow, tube-like passage having a diameter as hole 254 thereby permitting passage of high pressure tube 231 and forming an annular conduit 258 for carrying low pressure hydraulic fluid. Portion 257 of mandrel carrier 247 is received within of tubular shaped setting sleeve carrier 263. During the setting action, sleeve carrier 263 will be displaced downward with respect to the mandrel carrier. Four set screws 265 assist in holding the sleeve carrier in place when the setting tool is not being actuated. When the setting tool is actuated, downward displacement of the sleeve carrier 263 shears set screws 265 after a short distance. Annular profile 266 allows for displacement of sleeve carrier 263 without shearing of set screws 265 that may occur prior to setting while running the setting tool in a well having very high temperatures.

O-ring 259 forms a rod seal between feedback mandrel 255 and mandrel carrier to prevent well fluids from entering annular conduit 258. A retainer 261 holds the rod seal in place.

The sleeve carrier 263 is screwed onto a threaded outside portion 267 of seal body 269 and secured there with set screws 271. The seal body forms a moving seal for hydraulic fluid reservoir 239. During actuation of the tool, seal body 269 slides down feedback mandrel 255. The seal body includes a cavity for a rod seal 273 that is formed with an O-ring and held in place with rod seal retainer 275. The seal body segment 269 is supported on the feedback mandrel by a rod bearing (not shown) in groove 277.

Setting cylinder 279 is screwed onto a lower threaded portion 281 of seal body segment 269, with the joint therebetween sealed with O-ring 283. Reservoir 239 extends within an annular space formed between the seal body 269 and feedback mandrel 255, extending up to port 285 sealed with plug 287. Plug 287 is removed to prime the setting tool with hydraulic fluid and to purge air and then replaced when the setting tool is filled.

Referring now to FIG. 1F, feedback mandrel 255 extends through hydraulic fluid reservoir 239 and its threaded lower end screws into a threaded receptacle 289 on a low-pressure side of setting chamber piston 291. A set screw 292 secures this joining. Feedback mandrel includes two openings or ports 290 through which hydraulic fluid flows into annular conduit 258.

Piston 291 separates hydraulic fluid reservoir 239, which stores hydraulic fluid under low pressure, from setting chamber 293 (FIG. 1G), into which fluid from reservoir 239 is pumped under high pressure during setting. A T-seal (not shown) is placed in annular groove 295 circumscribing Piston 291 to provide a seal between the piston and the inner walls of setting cylinder 279. Two bearings (not shown), one in each of two annular grooves 297 and 299, circumscribe the piston.

High pressure line 231 extends through but does not move relative to the axial center of the piston 291. An O-ring 301 circumscribes the high pressure line next to the piston 291 to seal the piston against the high pressure line and thereby to maintain separation of high and low pressure across the piston. The O-ring is held in place with retainer ring 303, the retainer ring being held by feedback mandrel 255.

Figure 1G:
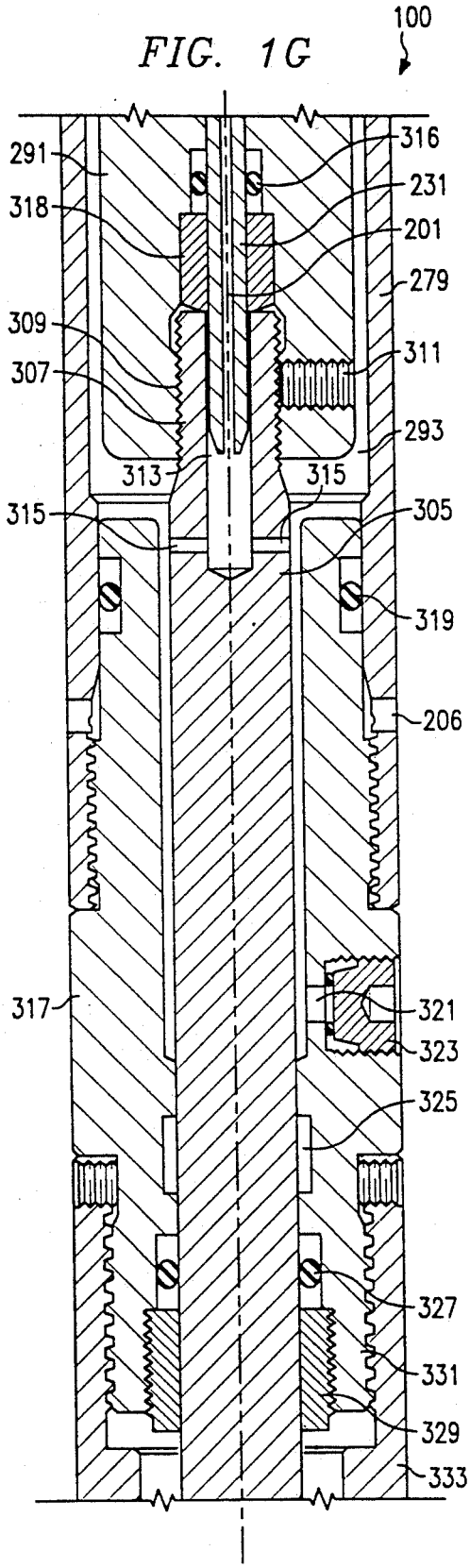

Referring now to FIG. 1G, setting mandrel 305 includes a threaded top end portion 307 that is screwed into a threaded receptacle 309 in the high pressure side of piston 291 and secured with set screw 311. Defined in the top end 307 of the setting mandrel is cavity 313 that receives an open, terminating end of the high pressure line 231. Cavity 313 includes two ports 315 through the top end of the setting mandrel. Top end portion 307 also seats against retaining ring 318 that holds an O-ring with backups 316 between the high pressure line 231 and the piston 291.

Seal body 317 seals the bottom end of setting cylinder 279, defining with the setting piston 291 and the setting cylinder the setting chamber 293. A lower interior of setting cylinder 279 is threaded to screw onto seal body 317. O-rings 319 seal the joining of the setting cylinder and the seal body 317. A port 321 between the setting chamber 293 and the outside of the setting tool is sealed with plug 323 that includes an O-ring. When the setting tool is being primed, plug 323 is removed to allow bleeding of the tool in order to purge air. The port also allows the setting chamber to be drained of hydraulic fluid.

Seal body 317 is circumscribed by annular groove 325, in which a rod bearing is placed so that the seal body slides on setting mandrel 305. O-ring with backups 327 seals the seal body against the setting mandrel 305. Threaded retaining ring 329 permits insertion and securing of the O-ring.

Figure 1H:
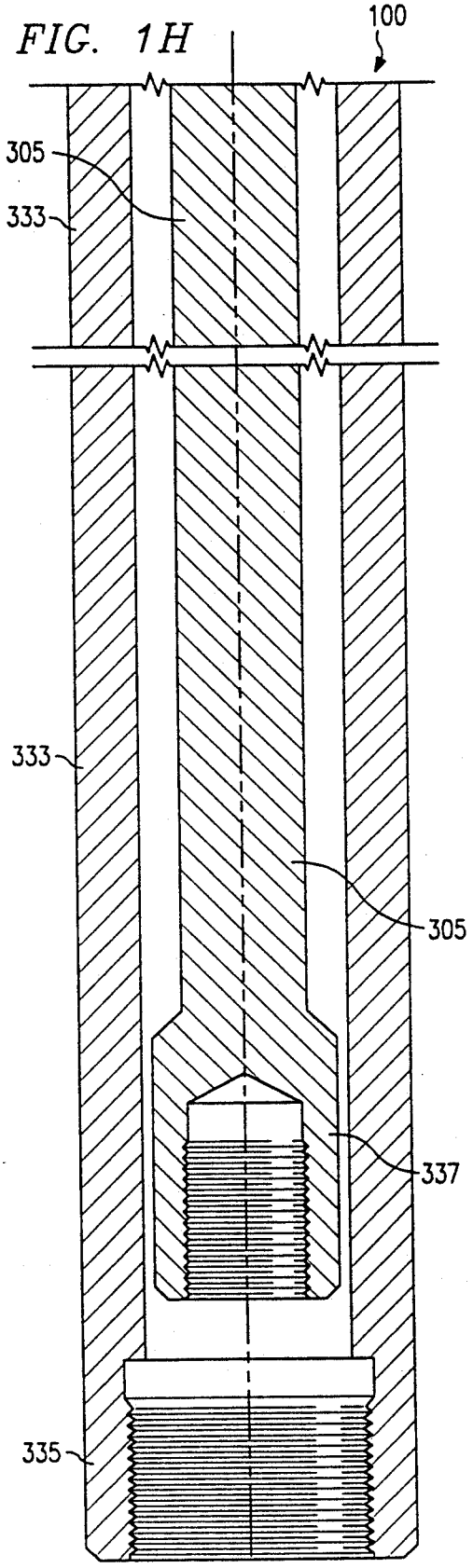

On threaded lower end 331 of the seal body 317 is screwed setting sleeve 333. Referring now to FIG. 1H, setting sleeve 333 terminates in a threaded section 335 for attaching an adaptor (not shown) for a top portion of a downhole device, such as a packer or plug (not shown) that will be set. The manufacturer of the device typically supplies the adaptor bit for the device. Setting mandrel 305 terminates in a threaded receptacle portion 337 for coupling to a frangible element (not shown) coupled to the downhole device.

Referring now to FIGS. 1A to 1H collectively, filling of the setting tool 100 is from the high pressure side of the hydraulic system. Plugs 197, 287 and 323 are removed. Valve 221 is opened to permit the fluid to flow into and to fill the hydraulic system in the low pressure side, including the reservoir 239 and accumulator fluid chamber 220. Hydraulic fluid is pumped under very low positive pressure through port 321 and into setting chamber 293. Port 321 is adapted to receive a source of hydraulic fluid. The hydraulic fluid then flows up the hydraulic system on the high pressure side of pump 183. When fluid begins flowing out ports 195 and 285, plugs 197 and 287 are replaced. Pumping pressure is increased to an amount greater than the setting of the pressure relief valve 203 in order to create a predetermined positive pressure throughout the tool and to preload the accumulator springs 245 so that accumulator piston 227 slides more easily. The pressure relief valve 203 blocks a flow of hydraulic fluid down high pressure fluid channel 201 until the predetermined positive back pressure is reached. Once this minimum pressure is reached, valve 221 is closed to separate low and high pressure side and to contain, in cooperation with pressure relief valve 203, the fluid on the low pressure side of the pump and thereby maintain pressure while the hydraulic fluid supply is disconnected from port 321 and plug 323 is replaced.

The setting tool 100 is actuated when it has been lowered down a well or borehole to the desired depth. An electrical signal is sent down a wireline to which it is attached. The voltage of the electrical signal determines the speed of the motor 131. The motor turns the pump 183, which begins to pump hydraulic fluid down the high pressure supply fluid channel 201, down high pressure channel and into the setting chamber 293. The speed of the motor determines the volume of the hydraulic fluid displaced by the pump, thereby providing control over the setting actions of the tool. Pumping of hydraulic fluid under high pressure into the setting chamber creates a pressure differential across the setting piston 291. The pressure differential causes a downward displacement of the seal body 317 relative to the piston. This, in turn, creates a downward displacement of setting sleeve 333 relative to the setting mandrel 305. The relative displacement of the setting sleeve to the setting mandrel, the setting action, exerts a shearing force on a down hole device to the setting mandrel that sets the device.

Downward displacement of the seal body increases the volume of the setting chamber 293 and decreases by the same volume reservoir 239. Thus, the overall volume of the setting tool's closed hydraulic system remains unchanged throughout the setting action. The decreasing volume in the reservoir displaces hydraulic fluid. The displaced hydraulic fluid flows under low pressure through ports 290 and up the low pressure be added if an even greater setting force is desired. Although the setting tool is shown as being constructed from a plurality of sections joined by threaded connections, any two or more of these sections may be of unitary construction if desired.

Figure 2A:
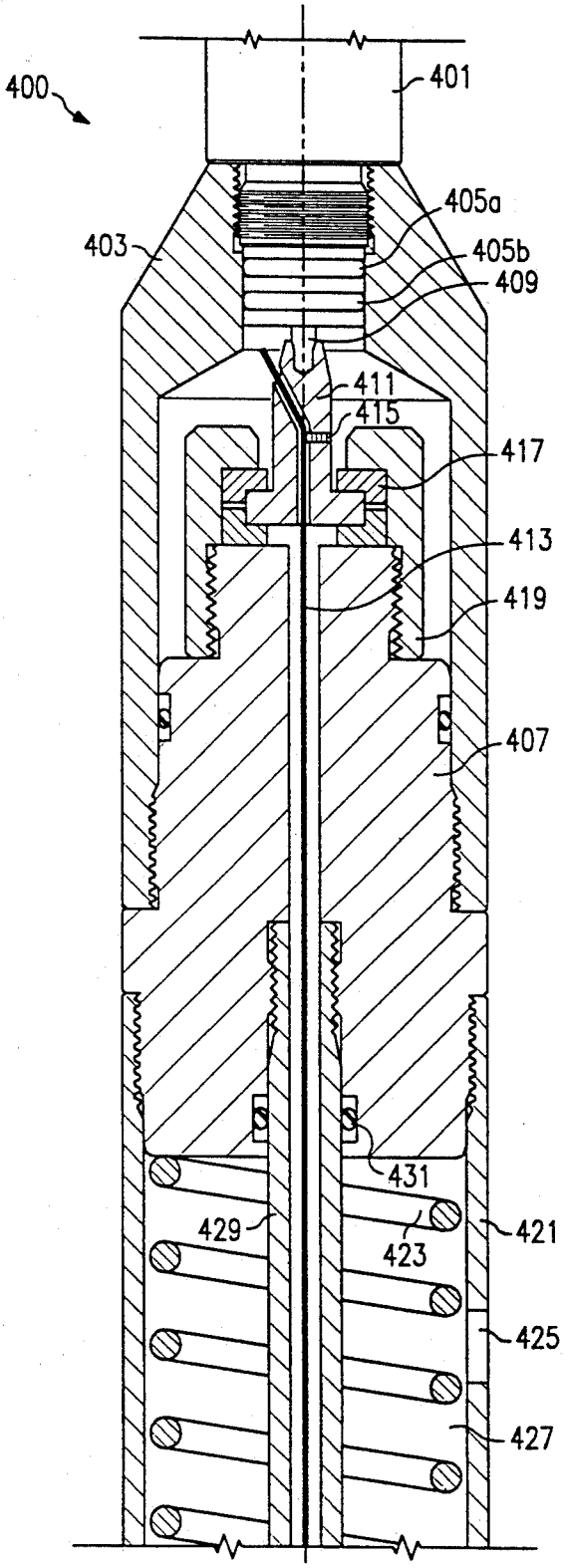
FIGS. 2, 2B, 2C, 2D, 2E, 2F and 2G are cross-sectional and cut-away elevational drawings, in some cases simplified for clarity or ease of presentation, illustrating segments of a second embodiment of a setting tool.

Referring now to FIG. 2A only, screwed onto a threaded portion of field connection 401, shown in elevation, is top connection 403. This coupling is sealed by O-ring seals 405*a* and 405*b*. Top connection 403 is screwed onto a threaded upper portion of cable head carrier 407. Cable head 409 is coupled to a wire line (not shown) through field connection 401. Cable head 409 mates with cable head receptacle 411. Cable head provides a voltage (positive if a direct current motor is used, or alternating if alternating current motor is used) to the setting tool. The body of field connection 401 provides a ground.

Insulated wire 413 is electrically connected to the cable head receptacle 411 using set screw 415. Cable head receptacle is mounted to the seal body using plastic stand-offs 417 for electrically insulating the cable head receptacle from cable head carrier 407. The plastic stand-offs are held by retainer 419 that is screwed onto the cable head carrier 407.

Screwed onto a bottom end of cable head carrier 407 is tubular-shaped accumulator housing 421. The accumulator housing includes a port 425 for equalizing the pressure between the inside of the tool and the outside of the tool. This equalization channel to accumulator chamber 220. The pressure of the hydraulic fluid on the low pressure side remains relatively constant due to the reduction in the volume of the low pressure side of the setting tool's hydraulic system.

Thermal expansion of the fluid creates tremendous force that can affect the setting action and cause damage to the setting tool at the high temperature encountered in wells. To take up this expansion and alleviate the accompanying force, an increase in pressure accompanying an expansion of the volume of the hydraulic fluid pushes accumulator piston 227 downward to create more volume on the low pressure side of the hydraulic system.

After actuation of the tool, hydraulic fluid on the high pressure side of the pump is released into the low pressure side of the pump in order to collapse the setting tool. Opening bypass valve 221 allows hydraulic fluid to flow from the setting chamber 293, through the high pressure channel 201 and into the low pressure channel 219. From low pressure channel 293, into accumulator chamber 220 and then though the ports 243 to the reservoir 239.

Referring now to FIGS. 2A–2G, a setting tool 400 is shown in its collapsed position. The setting tool 400 is shown with a dual-stage hydraulic system for generating a setting force almost twice that of a single stage setting tool 100. Additional stages may reduces pressure differentials across seals, increasing the tool's reliability. Accumulator housing cavity 427 includes a coiled spring 423 and is packed with grease (not shown) during operation to prevent the void from filling up with well fluids. Hollow rod 429 carries insulated wire 413 through the accumulator housing. A threaded end of rod 429 screws into a threaded receptacle formed in cable head carrier 407 and the connection is sealed with O-ring 431.

Figure 2B:
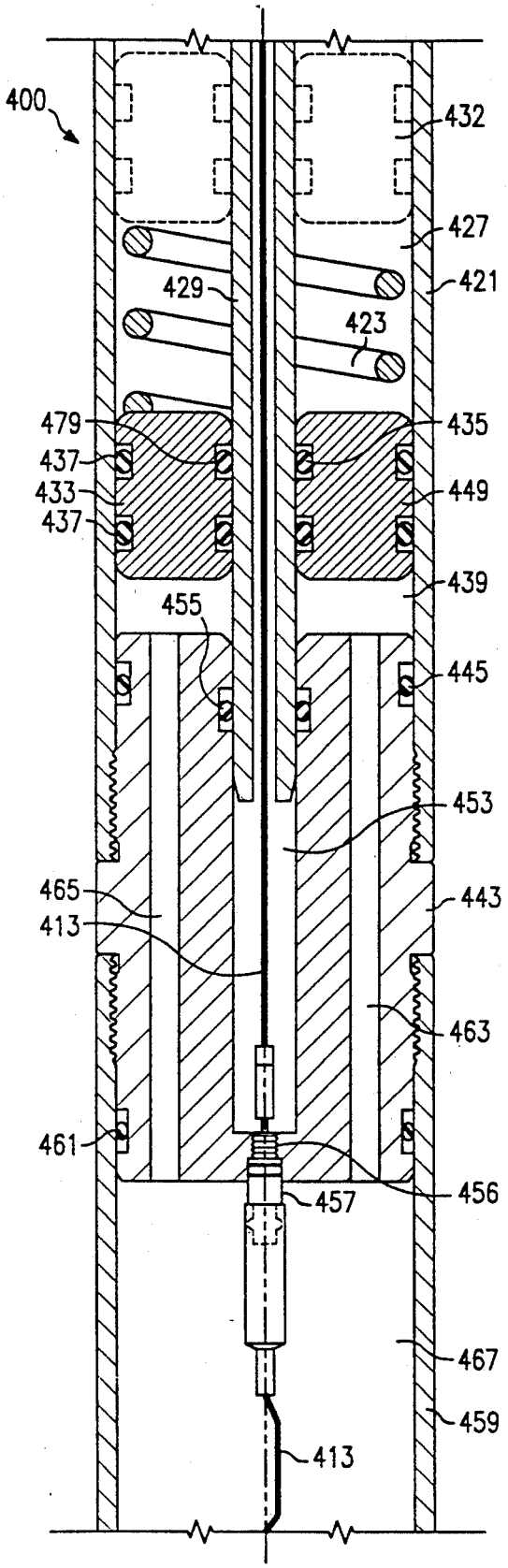

Referring now to FIG. 2B, accumulator piston 449 is disposed concentrically around hollow rod 429 for reciprocal linear movement within the accumulator housing along the rod. The piston includes O-rings 435 and 437 for sealing the piston against rod 429 and inner walls of accumulator housing 421.

Accumulator reservoir 439 is defined between piston 432, the inner wall of accumulator housing 421 and seal body 443. Its volume depends on the position of the piston 432. The position of the piston depends on the pressure exerted by hydraulic fluid pumped into the reservoir during filling and priming of the setting tool. The piston is shown in a collapsed position, biased there by the accumulator spring 423.

Figure 2C:
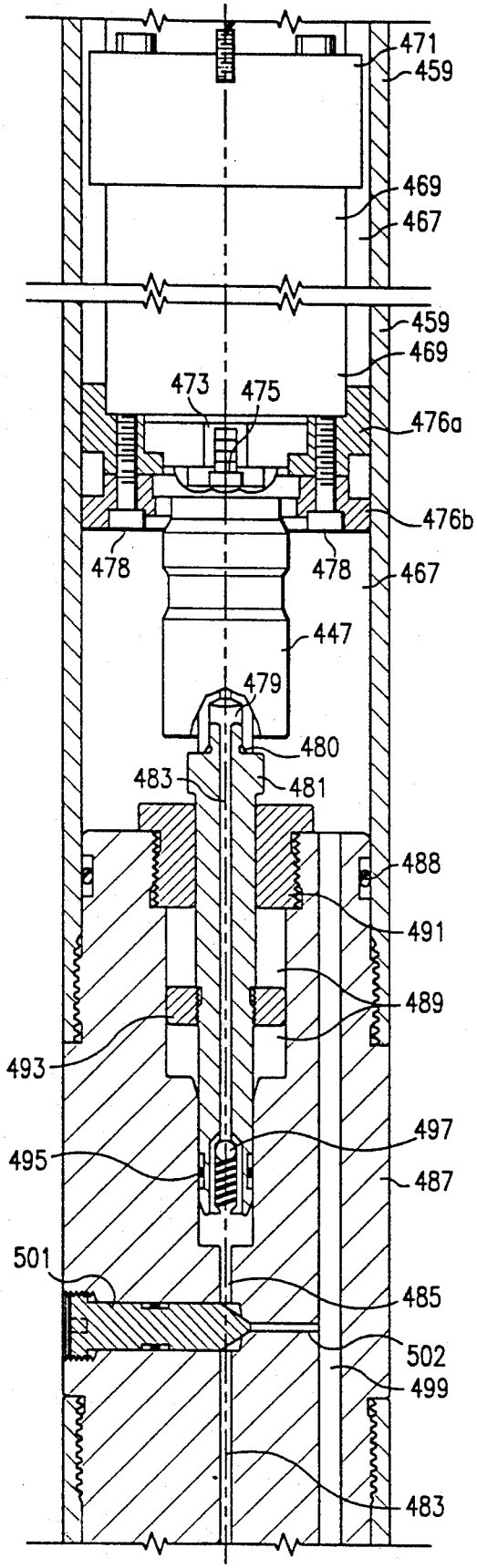

The accumulator functions as an expandable reservoir for hydraulic fluid that maintains a minimum positive pressure on hydraulic fluid in the reservoir to ensure uninterrupted flow of the oil to a hydraulic pump 447 (FIG. 2C). The accumulator also functions to accommodate expansion of the volume of the hydraulic fluid during running of the tool in high temperature wells.

The accumulator housing 421 screws onto the seal body 443, with the joint between the housing and the seal body sealed with O-ring 445. The hollow rod 429 is guided into a cylindrical chamber 453 and is sealed against the chamber's inner wall with O-ring 455.

The insulated wire 413 for supplying power runs through the hollow center portion of rod 429 and exits into cylindrical chamber 453. To pass wire 413 through seal body 443, the wire is connected to feed through connector assembly 457. Feed through connector assembly 457, shown in elevation for simplicity, is a commercially available connector. It is sealed within opening 456 in the seal body 443 to provide an hydraulic seal. The connector electrically couples the segment of wire 413 in the seal body to the segment in motor and pump housing 459 while electrically insulating the wire from the seal body 443.

Motor and pump housing 459 is a hollow cylindrical section that screws onto the lower end of seal body 443 and sealed against the outside of the tool with O-ring 461. Passageways 463 and 465 in the seal body 443 establish fluid communication between the accumulator reservoir 439 and an interior volume 467 of motor and pump housing 459. During actuation of the setting tool, hydraulic fluid flows from reservoir 439 and into the interior volume 467.

Referring now to FIG. 2C, mounted within an interior void 467 of motor and pump housing 459 is a brushless direct current motor 469 and hydraulic pump 447. The brushless direct current motor is designed for "wet" operation, as hydraulic fluid fills the interior void 467 during operation of the setting tool. The hydraulic fluid used in the setting tool must, consequently, be of a dielectric type. Running the motor "wet" offers the advantage of using the hydraulic fluid to cool the motor and allows interior of the setting tool and the motor to operate at the hydrostatic pressure of the well fluids.

The motor 469 is preferably a three phase "y" connected bipolar direct current motor. The motor is connected to insulated wire 413 for receiving a voltage signal that determines the speed of the motor. The motor includes a hermetically sealed controller unit 471 that provides electronic commutation and relies on either Hall effect or EMF sensing. The controller 471 regulates the commutation of the motor to produce high output torque and produce constant speed (depending on the voltage on wire 413) under a range of loads that the tool is expected to encounter. Because the motor and controller must be compact, the controller is implemented with hybrid circuitry. This circuitry is made to withstand high temperatures of 400° Fahrenheit that may exist in deep wells in which setting tool 400 may be expected to run.

The motor shaft 473 is coupled for rotation to input shaft 475 of hydraulic pump 447. The pump is a commercially available, axial piston hydraulic pump. Note that most of the pump is shown in elevation. The volumetric displacement of the pump is proportional to the speed at which the pump is driven, assuming that there is little compression of hydraulic fluid being pumped and no air entrained in the fluid. This enables calculation at the surface of the well of the volume of hydraulic oil displaced by the pump and thus the amount of the setting tool's actuation.

Motor 469 is coupled to pump 447 with flange elements 476*a* and 476*b* and screws 478. Pump 447 is mounted on pump mount 481 with threads (not shown) on the interior surface of pump outlet 479 and exterior surface of the top end of pump mount 481.

The pump 447 draws in hydraulic fluid at hydrostatic pressure in interior void 467 and delivers fluid at relatively higher pressure through its output 479 to a hole 483 that is defined through the center of pump mount 481. Pump mount 481 is sealed against output 479 with a metal seal (not shown) in annular groove 480. The hole 483 carries hydraulic fluid from the pump to a high pressure channel 485 formed by a hole in valve block 487.

The motor and pump housing 459 is screwed onto a threaded top end of valve block 487 and sealed with O-ring 488. Pump mount 481 inserts into a tiered cavity defined in valve block 487 and is supported therein by a shock mount formed of rubber sections 489, gland 491 that threads onto valve block 487 to secure the rubber sections in the cavity in the valve block, and collar 493 screwed onto threads on the outer diameter of the pump mount to secure the pump mount in the axial direction. The bottom end of the pump mount 481 is sealed against the valve block 487 with O-ring 495. The open end of pump mount 481 is fitted with a pressure relief valve 497 that is biased to allow fluid flow from the pump into high pressure line 485 only when it exceeds a minimum predetermined pressure. The relief valve enables maintaining a minimum, positive pressure on the low pressure side of the hydraulic system of the setting tool.

Valve block 487 also forms low pressure hydraulic fluid channel 499. By-pass valve 501 closes by-pass channel 502 that connects high pressure line 485 to low pressure channel 499 for fluid communication. During operation of the setting tool, valve 501 is closed against the opening to by-pass channel 502. This permits high pressure fluid to flow around the valve in high pressure channel 485. After running of the setting tool, the by-pass valve is opened to permit flowing of hydraulic fluid to the low pressure side of the hydraulic system so that the setting tool may be collapsed.

Figure 2D:
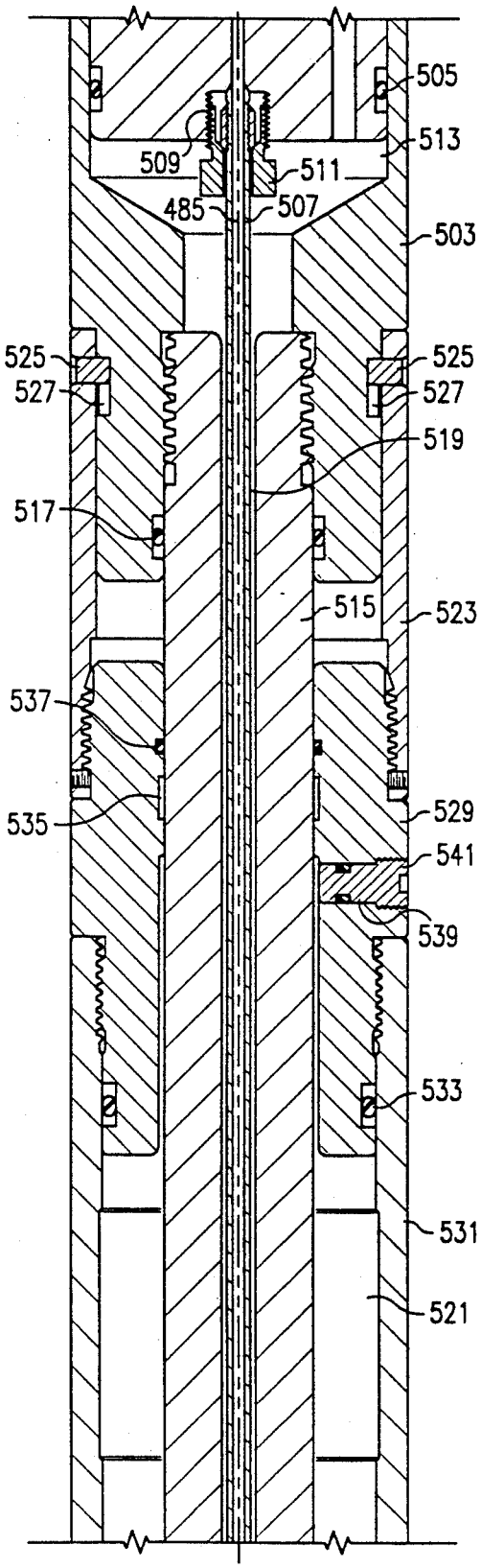

Referring now to FIG. 2D, a threaded outer surface of the lower end of valve block 487 receives and joins a threaded inner surface of mandrel carrier housing 503. O-ring 505 seals the connection. High pressure tube 507 is positioned against terminating walls of channel 485 using collar 509 and retaining gland 511 to form a high pressure seal. The low pressure channel 499 is open to void 513, which is filled with hydraulic fluid under low pressure when the setting tool is charged with hydraulic fluid.

First stage feedback mandrel 515 is attached by threaded connection to mandrel carrier 503 and sealed with O-ring 517. Mandrel 515 is hollow, having in inner tubularshaped channel running its length. In the channel is run high pressure tube 507. Between the tube's outer wall and the inner wall of the channel is formed an annularshaped channel 519 running the length of the mandrel. Channel 519 carries hydraulic fluid under low pressure from primary hydraulic fluid reservoir 521.

Extending over mandrel carrier is tubular-shaped sleeve carrier 523. Set screws 525 hold the sleeve carrier in the position shown when the tool is stored, being prepared for running and being conveyed to the desired depth in the hole. Space 527 allows for minor displacement of sleeve carrier 523 due to thermal expansion of hydraulic fluid. During actuation, sleeve carrier 523 moves downwardly with respect to mandrel carrier 503, causing set screws 525 to shear.

A lower end of sleeve carrier 523 is joined by a threaded connection to a top end of seal body 529. Joined by another threaded connection to a bottom end of seal body 529 is tubular-shaped first stage setting cylinder 531. O-ring 533 seals the connection. Seal body 529 includes rod bearings 535 to enable the seal body to slide along a smooth outer surface of mandrel 515. O-ring 537 provides a seal. Seal body 529 is provided with a port 539 that is sealed with removable cap 541.

Figure 2E:
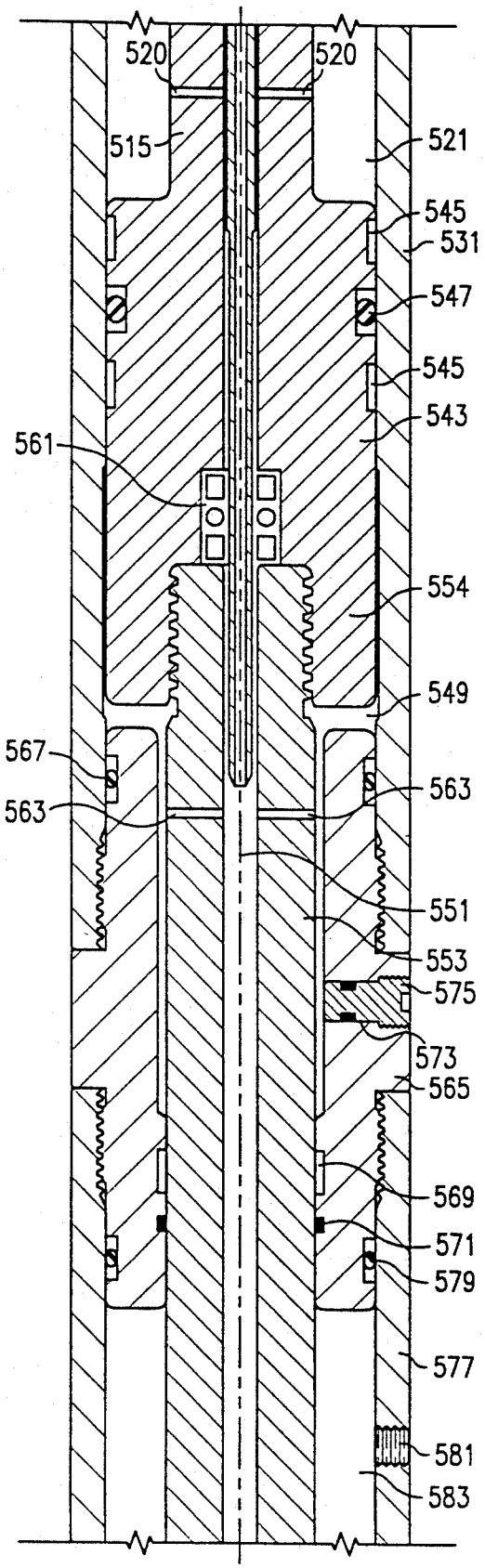

Referring now to FIG. 2E, a first stage setting piston 543, integrally formed with the first stage feedback mandrel 515, is disposed within the first stage setting cylinder 531 for translational movement relative to the length of the setting cylinder. Piston 543 includes two rod bearings (not shown) in annular grooves 545 and an O-ring seal 547 to seal reservoir 521 from first stage setting chamber 549. High pressure tube 507 passes through a passageway defined through the center of the piston 543 and into a inner tubular shaped channel 551 defined through the center of second stage feedback mandrel 553. The high pressure tube 507 terminates in an open end within channel 551. O-ring with back-ups 561 forms a seal between the reservoir 521 under low pressure from the setting chamber 549.

Second stage feedback mandrel 553 is screwed into a threaded socket 554 in piston 543. Mandrel 553 includes high pressure ports 563 through which a portion of hydraulic fluid under high pressure in channel 551 flows into setting chamber 549.

First stage setting cylinder 531 screws onto a threaded top portion of the first setting chamber seal body 565. This connection is sealed with O-ring 567. Rod bearings (not shown) in profile 569 support seal body 565 for translation along second stage feedback mandrel 553. O-ring seal 571 seals body seal 565 against second stage feedback mandrel 553. Seal body 565 includes a port for fluid communication with setting chamber 549 that is capped with plug 575 and sealed with an O-ring. The port permits bleeding or purging of air from the first setting chamber 549 during filling of the setting tool as well as, if necessary, permitting relief of high pressure fluid in the setting chamber.

Second stage setting cylinder 577, like the first stage setting cylinder, is tubular shaped and includes threads for securing the sleeve to the bottom threaded portion of seal body 565, where it is sealed with O-ring 579. Second stage setting cylinder includes a threaded port 581 between interior space 583 and the environment. The port permits well fluids to pressurize grease injected into the interior space 583 of the second setting sleeve at the hydrostatic well pressure. The grease keeps well fluids out and prevents contamination. The port is threaded for receiving a grease gun for injection of grease into the interior space 583. Injecting grease under pressure collapses the tool to a running position.

Figure 2F:
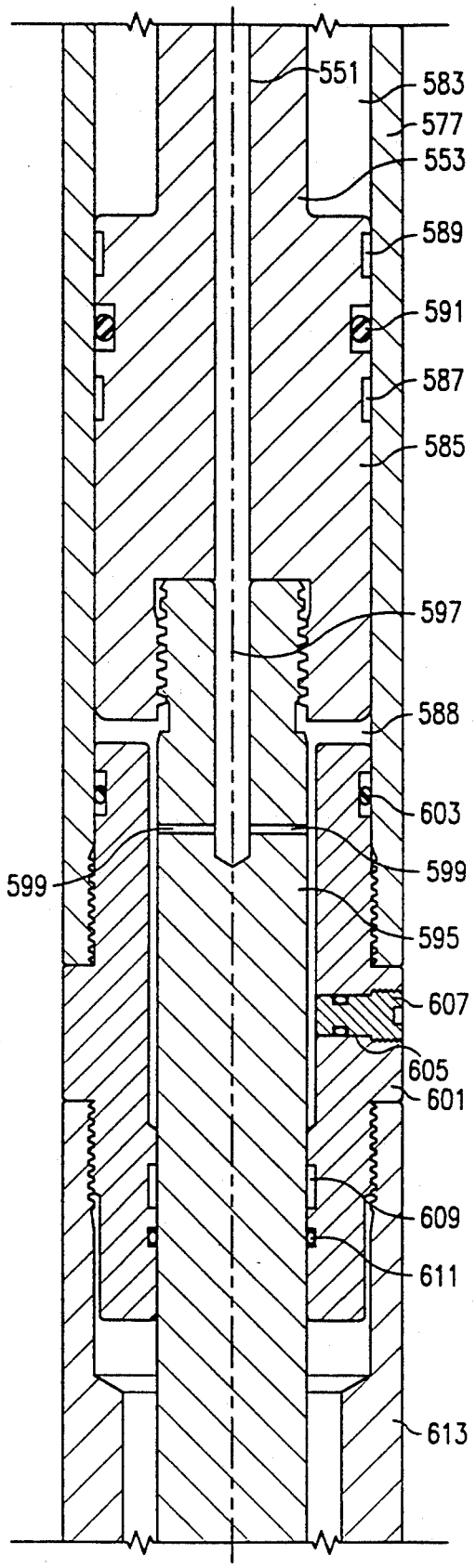

Referring now to FIG. 2F, the bottom end of second stage feedback mandrel 553 is integrally formed with second stage setting piston 585.

Second stage setting piston 585 slides translationally within second stage setting cylinder 577. The setting piston is provided with rod bearings 589 and O-ring 591 for sealing against the inner wall of the second stage setting cylinder 577. Into a threaded socket on the piston's bottom end is screwed threaded top end of setting mandrel 595. Setting mandrel 595 includes a closed-end channel 597 in fluid communication with channel 551 of piston 585 for receiving a flow of hydraulic fluid under high pressure. The setting mandrel includes exit ports 599 for the channel 597 to flow hydraulic fluid to second stage setting chamber 588.

Figure 2G:
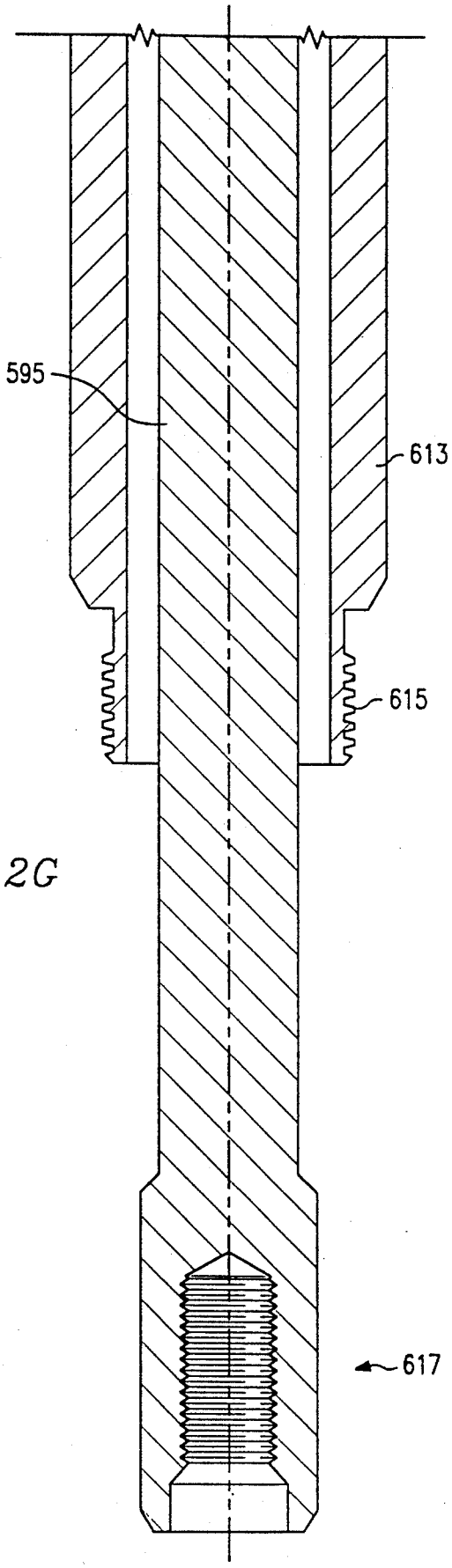

Second stage setting cylinder 577 screws over the threaded top portion of second stage seal body 601 and is sealed with O-ring 603. Seal body 601 includes a port 605 in fluid communication with second stage setting chamber 588 for bleeding air and draining hydraulic fluid from the setting chamber. The port is normally closed with removable cap 607 and sealed with an O-ring. The second stage seal body includes rod bearings (not shown) in annular profile 609 and O-ring 611 for sealing setting chamber 588 against the setting mandrel while permitting the setting mandrel to slide translationally relative to the seal body. On a threaded bottom end of seal body 601 is screwed setting sleeve 613. Referring now to FIG. 2G, setting sleeve 613 and setting mandrel 595 each terminate in a threaded end portion 615 and 617 respectively that are industry standard connections for fitting with kits (not shown) that specially adapt to downhole devices (not shown).

Referring now to FIGS. 2A–2G collectively, before setting tool 400 is filled, caps 541, 575 and 607 are removed to permit purging of air. Filling takes place from the high pressure side of the pump. Valve 501 is opened to directly connect the high pressure side of the pump to the lower pressure side. Hydraulic fluid is pumped under pressure into port 607 and makes its way up through the setting tool to the valve 501. As hydraulic fluid continues to be pumped, it flows into void 513 and down into first stage setting chamber reservoir 521. The fluid also flows up through low pressure supply line 499 and into the interior void 467 of the motor and pump housing 459. From the interior void 467 of the motor and pump housing, hydraulic fluid flows up through passageways 463 and 465 and into accumulator reservoir 439. As the hydraulic fluid builds up pressure, the fluid overcomes the compressive force of the spring 423 and begins to displace the accumulator piston 433, as indicated by the piston shown in phantom. The displacement of the accumulator piston depends on the set pressure of the pressure relief valve 497, but the volume of the accumulator reservoir 439 must be at least one-half of the volume of hydraulic fluid required to actuate the tool plus a small additional amount to compensate for any possible compression of the fluid. When fluid begins flowing out of ports 539 and 573, they are capped. The valve 501 is then closed. The pressure relief valve maintains positive pressure on the low pressure side and thereby permits removal of the source of hydraulic fluid and capping of port 605 without loss of hydraulic fluid from the low pressure side.

When the setting tool 400 is actuated, the hydraulic pump 447 pumps hydraulic fluid under high pressure to the setting chambers 549 and 588 through channels 483 and 485, tube 507, and channels 551 and 597. The pressure of the fluid in the first stage setting chamber 549 acts against seal body 565; and the pressure of the fluid in the second stage setting chamber 588 acts against seal body 601. There is a corresponding increase in the volumes of the setting chambers, resulting in displacing of the seal bodies 565 and 601 by equal amounts relative to pistons 543 and 585. The pistons, along with the mandrels 515, 553 and 595, stay stationary with respect to the setting tool. As setting cylinders 531 and 577 and setting sleeve 613 are coupled together with seal bodies 565 and 601, they are displaced as well, creating the shearing action of the setting motion.

Seal body 529 is also displaced relative to the first stage setting piston 543, thereby reducing the volume of first stage reservoir 521 by an amount equal to one half of the hydraulic fluid pumped by pump 447 into the first and second stage setting chambers. The hydraulic fluid displaced flows up through channel 519, void 513 and low pressure channel 499 to the interior void 467 of the motor and pump housing. The other half of the oil that is pumped to the setting chambers is supplied from accumulator reservoir 439. The accumulator piston, under pressure of the well through the grease packs in accumulator cavity 427 and the spring 423, decreases the volume of the accumulator reservoir 439 by one half the volume of the hydraulic fluid pumped and maintains the positive pressure of the fluid to ensure consistent supply to the pump to prevent entrainment of air.

The setting tool is balanced with respect to the hydrostatic pressures in the well. Acting through port 425 in the setting tool, the hydrostatic pressure loads grease in accumulator housing cavity 427, which in turn loads the hydraulic fluid in the setting tool through accumulator piston 433. This loading eliminates pressure differential across numerous seals in the setting tool and thus makes the seals simpler and more reliable. Reliable seals are especially important when running the tool in deep wells under high hydrostatic pressures.

So that the setting force need not act against the pressure in the well, well fluids act against first stage seal body 529 in the direction of the application of the setting force. Similarly, well fluids are permitted to act on second stage setting piston 585, in the direction of the setting force, through port 581.

If the hydraulic fluid undergoes thermal expansion due to high temperatures in the well, accumulator piston 432 is displaced a sufficient volume by the force generated by the expanding fluid to relieve substantially all of the pressure from the expanding fluid.

The foregoing detailed description is only an illustration and example of the invention. Numerous modifications of the disclosed embodiment will be apparent to those of ordinary skill in the art that do not depart from the spirit and scope of the invention. The spirit and scope of the invention is intended to be limited solely by the appended claims.

What is claimed is:

1. A setting tool comprising:

a setting mandrel;

a setting sleeve disposed in relation to the mandrel for imparting a shearing action to a downhole device;

a setting cylinder and piston disposed within the setting cylinder for reciprocal linear, axial movement, the setting cylinder coupled to the setting sleeve and the piston coupled to the internal mandrel, the relative movement of the setting cylinder and piston causing the shearing action;

a hydraulic pump driven by a motor coupled to the pump;

a reservoir formed by the setting cylinder and one of two ends of the piston, the reservoir in fluid communication with a low pressure side of the hydraulic pump for supplying hydraulic fluid to the hydraulic pump for pumping; and a setting chamber formed by the setting cylinder and the second of the two ends of the piston, the setting chamber in fluid communication with a high pressure side of the hydraulic pump for receiving pumped hydraulic fluid and causing displacement of the piston within the setting cylinder to create the shearing action, thereby simultaneously decreasing the reservoir's volume to maintain a positive pressure of hydraulic fluid on the low pressure side of the pump to the pump that tends to reduce the possibility of pump cavitation due to entrainment of air in the hydraulic fluid.

2. The setting tool in claim 1 further comprising an accumulator in fluid communication with the reservoir and the hydraulic pump, the accumulator taking up thermal expansion in hydraulic fluid on the pump's low pressure side to thereby relieve forces caused by thermal expansion.

3. The setting tool of claim 1 further comprising safety relief valve on the high pressure side of the hydraulic pump to provide a back pressure to the pump that tends to prevent pump cavitation.

4. The setting tool of claim 1 wherein the motor is an electric motor the speed of which is controlled by a signal supplied to the setting tool from a wire line running to the surface, and wherein the pump is a positive displacement type of pump, the electric motor and the pump enabling control over the displacement of the piston within the cylinder, and thus the relative displacement of the setting sleeve and the internal mandrel by controlling the speed of the electric motor and the time of the motor's operation.

5. The setting tool of claim 1 wherein the internal pressure of hydraulic fluid stored in the reservoir is pressurizable, when the setting tool is conveyed down a well, pressurized with hydrostatic pressure of a well to avoid balanced operation of the setting tool.

6. A setting tool comprising:

a setting mandrel;

a setting sleeve disposed in relation to the mandrel for imparting a shearing action on a downhole device, a first setting cylinder and a first piston disposed within the first setting cylinder for reciprocal axial movement;

a second setting cylinder and a second piston disposed with the second setting cylinder for reciprocal axial movement, the second setting cylinder coupled to the first setting cylinder and the setting sleeve for unitary linear movement, and the second piston coupled to the first piston and the internal mandrel for unitary relative displacement with respect to the intercoupled first and second setting cylinders and setting sleeve, the relative displacement creating the shearing action;

a first setting chamber formed by the first setting cylinder and a first of two ends of the first piston;

a second setting chamber formed by the second setting cylinder and a first of two ends of the second piston;

a reservoir for holding hydraulic fluid formed by one of two the setting cylinders and a second of two ends of one of the two pistons; and a hydraulic pump coupled to a motor for driving the pump, a low pressure side of the hydraulic pump being in fluid communication with the reservoir for supplying hydraulic fluid to the hydraulic pump and a high pressure side of the hydraulic pump in fluid communication with the first and the second setting chambers for simultaneously delivering hydraulic fluid under high pressure to create the relative displacement, the relative displacement decreasing the volume of the reservoir thereby forcing hydraulic fluid to the hydraulic pump and assisting in maintaining a positive pressure of hydraulic fluid on the low pressure side of the pump that reduces the possibility of pump cavitation due to entrainment of air in the hydraulic fluid.

7. The setting tool of claim 6 wherein the hydraulic fluid on the lower pressure side of the pump is pressurized by hydrostatic pressure of well fluids when the setting tool is conveyed down a well, thereby balancing the internal pressures of the setting tool with the hydrostatic pressures of the well.

8. The setting tool of claim 7 further comprising an accumulator in fluid communication with the reservoir and the low pressure side of the pump, the accumulator having a pressure-dependent expansible chamber for accommodating a changing volume of hydraulic fluid and placing the hydraulic fluid under pressure, the accumulator coupling the hydrostatic pressure of fluids in a well to the hydraulic fluid to pressurize hydraulic fluid on the low pressure side of the pump at hydrostatic pressure.

9. The setting tool of claim 8 further comprising a chamber formed by a second of the two the setting cylinders and a second end of the second of the two pistons, the chamber including a port for receiving hydrostatic pressure of well fluids when tool is lowered into a well.

10. The setting tool of claim 6 wherein the motor is an electric motor the speed of which is controlled by a signal supplied to the setting tool from a wire line running to the surface, and wherein the pump is a positive displacement type of pump, the electric motor and the pump enabling control over the relative displacement of the setting tool by controlling the speed of the electric motor and running the motor for a predetermined time.

11. The setting tool of claim 6 further comprising an accumulator reservoir in fluid communication with the low pressure side of the pump and the reservoir, the accumulation reservoir storing hydraulic fluid for supplying the hydraulic pump and assisting in placing positive pressure on the hydraulic fluid on the low pressure side of the hydraulic pump while accommodating thermal expansions of hydraulic fluid.

12. A method of setting a downhole device comprising steps of:

conveying on a wireline a setting tool coupled to a downhole device from a surface into a well hole, the setting tool including an electric motor coupled to a hydraulic pump, the motor running at a speed determined by a signal applied to the motor, the output displacement of the hydraulic pump being determined by the speed of the motor, and the setting tool having a stroke determined by the volume of hydraulic fluid displaced by the hydraulic pump; and actuating the tool to create a desired setting action to set the downhole device in the well, the setting action having a predetermined stroke rate, the step of actuating the tool including a step of sending a predetermined signal for a predetermined time to the motor on the wireline from the surface, the signal operating the motor at a predetermined speed and thereby driving the pump at a predetermined displacement rate.

13. The method of claim 12 wherein the electric motor is a direct current motor whose speed is determined the voltage of the signal sent on the wireline from the surface.

14. A method for setting a downhole device with a wireline conveyed setting tool, the wireline setting tool carrying a direct current motor in electrical communication with a power supply on the surface, the direct current motor turning an output shaft at a speed related to a voltage supplied to the dc motor from the power supply, the output shaft driving a hydraulic pump having a fluid displacement dependent on the speed of the output shaft, the hydraulic fluid from the pump actuating the setting tool; the method comprising steps of:

conveying down a bore hole the setting tool having attached thereto a downhole device to be set; and applying a predetermined voltage for a predetermined time to the direct current motor with the wireline, the voltage and time corresponding to a stroke rate and stroke of the setting tool desired for setting the downhole device.

15. A setting tool comprising:

a setting mandrel;

a setting sleeve disposed in relation to the mandrel for imparting a shearing action to a downhole device;

a setting cylinder and piston disposed within the setting cylinder for reciprocal linear, axial displacement; the setting cylinder coupled to the setting sleeve and the piston coupled to the internal mandrel, and the relative displacement of the setting cylinder and piston causing the shearing action;

a hydraulic pump for pumping hydraulic fluid under pressure to a setting chamber formed by the piston and the setting cylinder for inducing relative displacement of the setting cylinder and the piston; and a brushless direct current motor coupled to the hydraulic pump for driving the hydraulic pump while submersed in hydraulic fluid.

16. The setting tool of claim 15 further comprising a low-pressure chamber in which is mounted the hydraulic pump and the brushless direct current motor, the low pressure chamber being filled with hydraulic fluid for supplying the hydraulic pump during operation of the setting tool.

17. The setting tool of claim 16 further including means for loading the hydraulic fluid in the low-pressure chamber with hydrostatic pressure of a well during operation of the tool.

* * * * *